US005887742A

United States Patent [19]

Lewis

[11] Patent Number: 5,887,742

[45] Date of Patent: Mar. 30, 1999

[54] BUG GUARD FOR BEVERAGE CAN

[76] Inventor: Jimmie Lewis, 523 Indian Lake Rd., Oxford, Mich. 48871

[21] Appl. No.: 984,595

[22] Filed: Dec. 3, 1997

Related U.S. Application Data

[60] Provisional application No. 60/043,143, Apr. 11, 1997.

[51] Int. Cl.[6] ..... B65D 51/18

[52] U.S. Cl. ..... 220/253; 220/730

[58] Field of Search ..... 220/253, 254, 220/256, 258, 269, 270, 906, 733, 730, 729, 703, 711, 713, 716, 694

[56] References Cited

U.S. PATENT DOCUMENTS

| | | | |
|---|---|---|---|
| 2,927,695 | 3/1960 | Bartolomeo . | |
| 2,940,645 | 6/1960 | Albiani . | |
| 3,292,828 | 12/1966 | Stuart . | |
| 3,938,695 | 2/1976 | Ruff . | |
| 4,029,033 | 6/1977 | Kerwin et al. . | |
| 4,083,471 | 4/1978 | Frank . | |
| 4,537,326 | 8/1985 | Morehead . | |
| 4,634,014 | 1/1987 | Carr | 220/694 |
| 4,852,763 | 8/1989 | Dimberio | 220/254 X |
| 5,269,432 | 12/1993 | Beckertgis | 220/253 |
| 5,379,914 | 1/1995 | Martins . | |
| 5,452,818 | 9/1995 | Yost | 220/258 |
| 5,547,100 | 8/1996 | Johnson | 220/730 X |
| 5,555,993 | 9/1996 | Borkowski et al. | 220/730 X |
| 5,720,412 | 2/1998 | Ficken | 220/730 X |

*Primary Examiner*—Stephen K. Cronin
*Assistant Examiner*—Nathan Newhouse
*Attorney, Agent, or Firm*—Howard & Howard

[57] ABSTRACT

A bug guard for a beverage can includes a retaining slot adapted to receive over the can tab actuator. The bug guard is secured to the top lid of the can by bending the tab actuator upward, sliding the tab actuator through the retaining slot, and bending the tab actuator downward. The bug guard includes a plurality of apertures in alignment with the drink opening to allow a consumer to drink from the can while preventing insects and debris from entering the can through the drink opening.

15 Claims, 2 Drawing Sheets

BUG GUARD FOR BEVERAGE CAN

This application claims the benefit of U.S. Provisional Application No. 60/043,143, filed Apr. 11, 1997.

This invention relates to an aperture cover for a drink opening in a liquid container.

Conventional beverage cans typically have a tab actuator which may be pivoted to shear open a drink opening located in the top of the can. Beverages sold in this type of can, such as soda pop and beer, attract insects, which may fly into beverage cans through the drink opening. Besides being unappetizing, this invasion spreads germs and may be hazardous to the consumer's health. Thus, there is a need for a cover which allows beverage to flow out of the can while preventing insects, such as bees, from flying into the can.

Several types of covers have been proposed in the prior art, however, the covers have not been practical or fully useful for various reasons. For example, U.S. Pat. No. 4,537,326 discloses several embodiments of a cover for a beverage can. Each of these embodiments employs an adhesive, which may not be sanitary, or a cover retaining structure which must be manufactured into the tab actuator of the beverage can. Accordingly, there is a need for a sanitary bug cover which may be manufactured and sold separate from the beverage can. Further, this bug cover should preferably be reusable.

SUMMARY OF THE INVENTION

The present invention provides a bug guard which may be installed by a consumer over a drink opening in a conventional beverage can having a tab actuator pivotable to open the drink opening. The bug guard includes a retaining slot adapted to receive the tab actuator. The bug guard is secured to the top lid of the can by bending the tab actuator upward, sliding the tab actuator through the retaining slot, and bending the tab actuator downward thereby pinching the bug guard between the tab actuator and the top lid of the can.

The bug guard further includes plurality of apertures in alignment with the drink opening to allow the consumer to drink from the can while preventing insects and debris from entering the can through the drink opening. The apertures are designed to accommodate a forward end of the tab actuator.

These and other features of this invention will be best understood from the following specification and drawings, the following of which is a brief description.

DETAILED DESCRIPTION OF A PREFERRED EMBODIMENT

Figure 1:
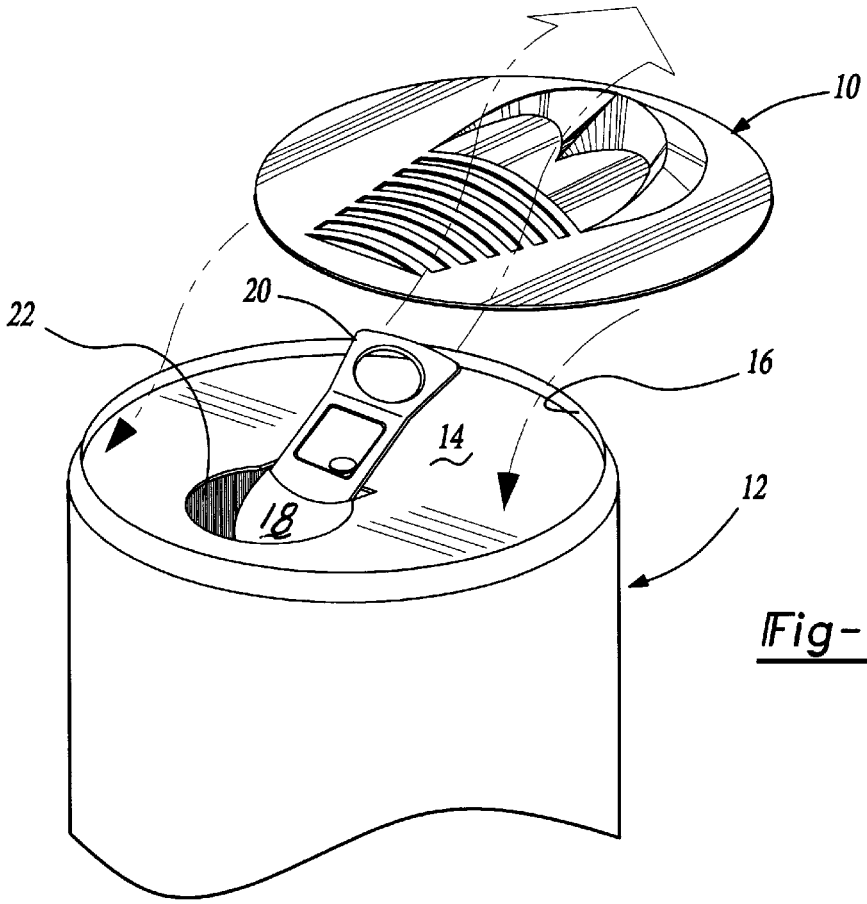
FIG. 1 is a perspective view of a bug cover, according to the present invention, aligned to be installed upon the top lid of a conventional opened beverage can.

FIG. 1 shows a perspective view of a bug cover 10, according to the present invention, aligned to be installed upon a conventional beverage can 12. Can 12 includes a top lid 14 surrounded by a lip 16 and having a shearable tab 18. Can 12 further includes a pliable tab actuator 20 riveted to lid 14. As known, tab actuator 20 is lifted upward thereby shearing tab 18 and creating a drink opening 22. With tab actuator 20 fixed in the lifted position as shown in FIG. 1, cover 10 may be installed upon can 12. The alignment arrow shown in FIG. 1 reveals the orientation required for cover 10 to fit on can 12.

Figure 2:
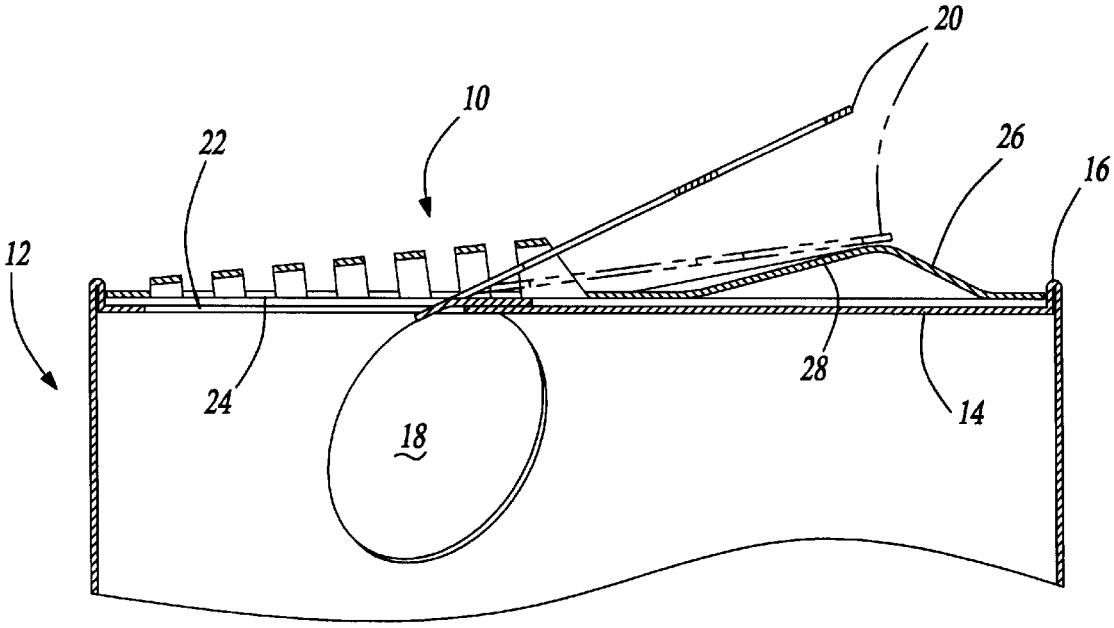
FIG. 2 is an enlarged, partially fragmented cross-sectional view of the bug cover installed upon the top lid of a conventional opened beverage can.

FIG. 2 shows a cross-sectional view of bug cover 10 installed on can 12 with tab actuator 20 in the lifted position. Cover 10 is preferably circular shaped and has a diameter slightly less than the diameter of lid 14. The bottom surface 24 of cover 10 may thus lie generally flush against lid 14 and inside of lip 16. Cover 10 further includes a raised portion 26. To retain cover 10 upon can 12, tab actuator 20 is pushed downward to a secured position, as shown in phantom in FIG. 2, to contact raised portion 26. As a result, cover 10 is pinched between tab actuator 20 and lid 14. Preferably, raised portion 26 is a ramp having an inclined edge 28 aligning with and contacting tab actuator 20 in the secured position.

Figure 3:
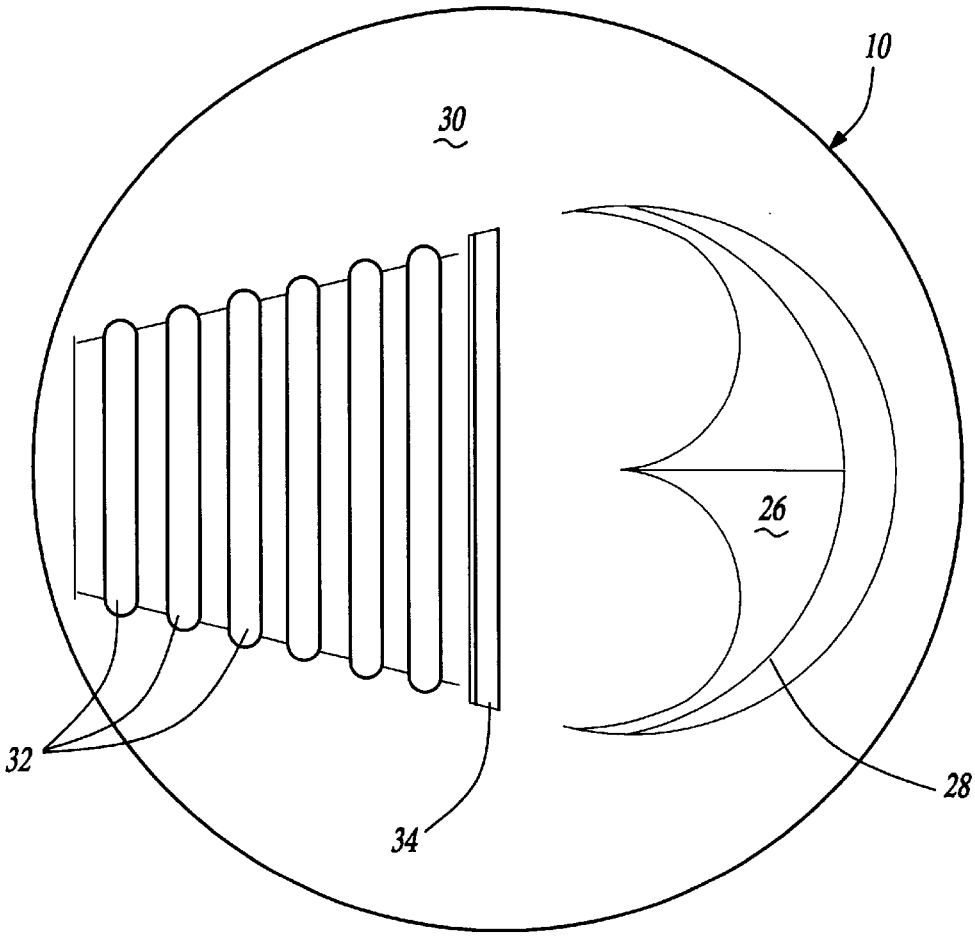
FIG. 3 is a top view of the bug cover.

FIG. 3 shows a top view of bug cover 10 including a cover body 30, a series of apertures or screen slots 32, and a retaining slot 34. Retaining slot 34 is shaped to receive tab actuator 20 and oriented to align the series of screen slots 32 over drink opening 22 when cover 10 is installed upon can 12. Each screen slot 32 extends parallel to retaining slot 34 and has a length equal to or greater than the respective portion of drink opening 22 over which the slot lies. Further, each screen slot 32 has a width allowing beverage to flow out of drink opening 22 while preventing insects and debris from entering drink opening 22. Preferably, body 30 is a single piece vacuum formed from polyvinyl chloride (PVC), injection molded from nylon, or stamped from stainless steel. One skilled in the art will recognize that other types of apertures, such as circular holes, may also be used to allow beverage to flow out of drink opening 22 while preventing insects and debris from entering drink opening 22.

Figure 4:
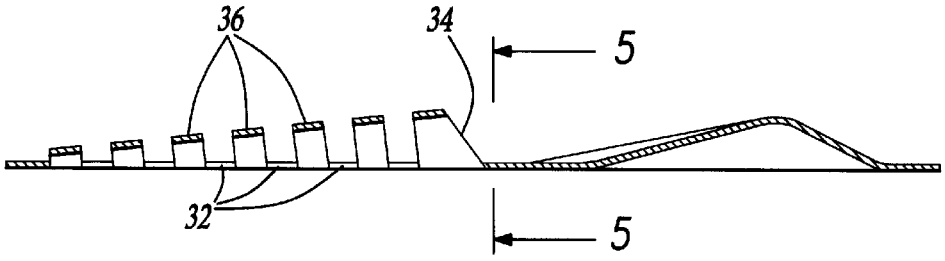
FIG. 4 is a cross-sectional view of the bug cover in FIG. 3.

FIG. 4 shows a cross-sectional view of bug cover 10. Cover 10 further includes a plurality of ribs 36, with one rib between each pair of spaced screen slots 32. Each consecutive rib 36, from the rib spaced furthest from tab actuator 20 to the rib closest to tab actuator 20, is of a greater height allowing the tab actuator 20 room to pivot between the lifted position and the secured position.

Figure 5:
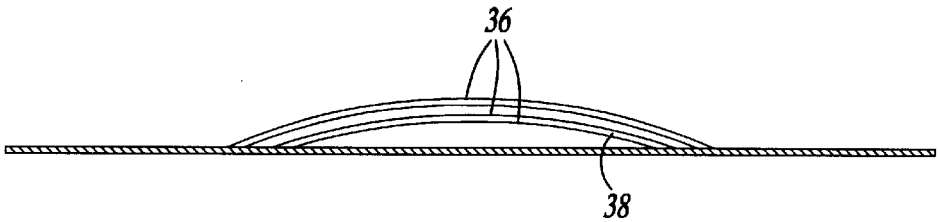
FIG. 5 is a cross-sectional view of the bug cover taken along lines 5—5 in FIG. 4.

FIG. 5 is a cross-sectional view of ribs 36 taken along lines 5—5 in FIG. 4 showing the curvature of each rib 36. The increasing curve and height of each rib forms a hollowed area 38 in which tab actuator 20 lies when cover 10 is installed upon can 12 as shown in FIG. 2.

The present invention further includes a method for covering a drink opening in a liquid container having a tab actuator pivotable to open the container. First, the tab actuator is lifted upward by a consumer thereby opening the container. Next, an aperture cover is slid by the consumer into position over the drink opening by aligning the tab actuator to extend through a retaining slot in the cover. Finally, the tab actuator is pushed downward by the consumer to engage and retain the cover to the container.

Although a preferred embodiment of this invention has been disclosed, a worker of ordinary skill in the art would recognize that certain modifications would come within the scope of this invention. For that reason, the following claims should be studied to determine the true scope and content of this invention.

What is claimed is:

1. A cover for a drink opening in a liquid container having a tab actuator pivotable to open the drink opening, the cover comprising:

a cover body including a plurality of apertures for alignment with the drink opening in the container, a retaining slot through which the tab actuator may extend to retain said cover body on the container, and a raised portion disposed adjacent to said retaining slot and on an opposed side of said retaining slot relative to said plurality of apertures, said raised portion for placement underneath the tab actuator after the container has been opened and the tab actuator has been extended through said retaining slot.

2. A cover as recited in claim 1, wherein said raised portion is a ramp having an inclined edge for alignment with the tab actuator after the container has been opened and the tab actuator has been extended through said retaining slot.

3. A cover as recited in claim 1, wherein the cover is formed from polyvinyl chloride (PVC).

4. A cover as recited in claim 1, wherein the cover is formed from nylon.

5. A cover as recited in claim 1, wherein the cover is formed from stainless steel.

6. A cover for a drink opening in a liquid container having a tab actuator pivotable to open the drink opening, the cover comprising:

a cover body including a retaining slot through which the tab actuator may extend to retain said cover body on the container, a series of spaced screen slots parallel to said retaining slot, said screen slots having a width allowing liquid to flow out of the drink opening while preventing insects from entering the drink opening, and a plurality of ribs formed between said series of screen slots, said ribs having a generally increasing height from a rib distal said retaining slot to a rib proximate said retaining slot.

7. A cover as recited in claim 6, wherein said cover body includes a raised portion adapted to engage the tab actuator after the container has been opened and the tab actuator has been extended through said retaining slot.

8. A cover as recited in claim 6, wherein each consecutive rib, from the rib distal said retaining slot to the rib proximate said retaining slot, is of a greater height.

9. A combination of a liquid container having a tab actuator pivotable to open a drink opening, and a cover for the drink opening comprising:

a liquid container having a drink opening and a tab actuator for opening said drink opening; and a cover body including a plurality of apertures placed over said drink opening in said container, a retaining slot receiving said tab actuator, and a plurality of ribs, wherein said cover body may be placed upon said container when said tab actuator is bent upward to a lifted position and secured when said tab actuator is bent downward to a secured position, said apertures being formed by a series of spaced screen slots extending parallel to said retaining slot, said screen slots having a width allowing liquid to flow out of said the drink opening while preventing insects and debris from entering said the drink opening, said plurality of ribs being formed between said series of spaced screen slots and having a generally increasing height from a rib distal said retaining slot to a rib proximate said retaining slot.

10. A combination as recited in claim 9, further including a raised portion adapted to engage said tab actuator in the secured position.

11. A combination as recited in claim 10, wherein said raised portion is a ramp having an inclined edge for alignment with said tab actuator in the secured position.

12. A combination as recited in claim 9, wherein each consecutive rib, from the rib distal said retaining slot to the rib proximate said retaining slot, is of a greater height.

13. A combination as recited in claim 9, wherein said cover is formed from polyvinyl chloride (PVC).

14. A combination as recited in claim 9, wherein said cover is formed from nylon.

15. A combination as recited in claim 9, wherein said cover is formed from stainless steel.

* * * * *